US006896746B2

(12) United States Patent
Tsuchida et al.

(10) Patent No.: US 6,896,746 B2
(45) Date of Patent: May 24, 2005

(54) HOT-ROLLED STEEL WIRE RODS AND BARS USABLE FOR MACHINE STRUCTURAL USE WITHOUT ANNEALING AND METHOD FOR PRODUCING THE SAME

(75) Inventors: Kiichiro Tsuchida, Muroran (JP); Koji Tanabe, Muroran (JP); Koji Adachi, Muroran (JP); Seiji Ito, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 140 days.

(21) Appl. No.: 10/240,952

(22) PCT Filed: Apr. 4, 2001

(86) PCT No.: PCT/JP01/02930

§ 371 (c)(1),
(2), (4) Date: Oct. 4, 2002

(87) PCT Pub. No.: WO01/75186

PCT Pub. Date: Oct. 11, 2001

(65) Prior Publication Data

US 2003/0098104 A1 May 29, 2003

(30) Foreign Application Priority Data

Apr. 4, 2000 (JP) ..... 2000-102721

(51) Int. Cl.[7] ..... C22C 37/02; C22C 38/04; C22C 38/00; C21D 8/06

(52) U.S. Cl. ..... 148/320; 148/598; 148/595; 148/660

(58) Field of Search ..... 148/598, 595, 148/320, 660

(56) References Cited

U.S. PATENT DOCUMENTS 6,475,306 B1 * 11/2002 Kanisawa et al. ..... 148/320
6,551,419 B2 * 4/2003 Kanisawa et al. ..... 148/320

FOREIGN PATENT DOCUMENTS

JP 2-213416 8/1990
JP 11-124655 5/1999

* cited by examiner

*Primary Examiner*—Deborah Yee
(74) *Attorney, Agent, or Firm*—Kenyon & Kenyon

(57) ABSTRACT

A steel wire rods and bars for machine structural use having, in the as-hot-rolled state, the same cold workability as a conventional steel wire rods and bars subjected to softening annealing after hot rolling, and a production method thereof are provided. This hot-rolled wire rods and bars usable for machine structural use without annealing comprises, in terms of mass %, C: 0.1 to 0.5%, Si: 0.01 to 0.5%, Mn: 0.3 to 1.5% and the balance of Fe and unavoidable impurities and if desired, comprises strengthening elements, wherein the microstructure of steel is composed of ferrite and pearlite, the ferrite grain size is No. 11 or more as defined in JIS G 0552, a granular carbide having an equivalent-circle diameter of 2 $\mu$m or less and an aspect ratio of 3 or less is contained in an area ratio of 5 to 40%, and the steel wire rods and bars has a tensile strength TS (MPa)$\leqq$573×Ceq+257 and a reduction of area RA (%)$\geqq$−23×Ceq+75 (wherein Ceq= C+Si/7+Mn/5+Cr/9+Mo/2).

9 Claims, 3 Drawing Sheets

(×4000)

HOT-ROLLED STEEL WIRE RODS AND BARS USABLE FOR MACHINE STRUCTURAL USE WITHOUT ANNEALING AND METHOD FOR PRODUCING THE SAME

TECHNICAL FIELD

The present invention relates to a hot-rolled steel wire rods and bars for machine structural use and a method for producing the same. More specifically, the present invention relates to a soft steel wire rods and bars capable of achieving, in the as-hot-rolled state, mechanical properties such as strength and deformation ability which are usually attained by hot rolling and subsequent softening annealing considered as an essential treatment in the secondary working step in the production of automobile parts, construction parts and the like, and also relates to a method for producing the same.

BACKGROUND ART

Conventionally, automobile parts, construction machine parts and the like are produced from a hot-rolled steel wire rods and bars through softening annealing to ensure cold workability, forming by cold working such as drawing and cold forging, and hardening and tempering. In the softening annealing step, for example, in the case of producing a bolt, as a machine part, from a hot-rolled wire, low-temperature annealing at about 650° C. for 2 hours is applied for stud bolt, and the like, with a small cold working amount, normal annealing at about 700° C. for 3 hours is applied for hexagon bolt and the like, and spheroidizing annealing at about 720° C. for 20 hours is applied for bolt with flange, and the like, with a large cold working amount, thereby ensuring cold workability. These softening annealing steps take a long time and moreover, the cost for annealing occupies a large portion of the cost for production of machine parts and the like due to a recent rise in energy price. Therefore, from the standpoint of improving the productivity and saving energy, various techniques have been proposed to avoid the softening annealing before the cold working. For example, there have been proposed a production method for a low alloy steel having excellent cold workability in Japanese Unexamined Patent Publication No. 57-73123, a direct softening method of steel wire rods and bars for structural use in Japanese Unexamined Patent Publication No. 58-58235, a production method of a directly softened wire and rod in Japanese Unexamined Patent Publication No. 2-185920, and a production method of a machine structure steel suitable for cold working in Japanese Unexamined Patent Publication No. 8-209236.

However, the as-hot-rolled steel wire rods and bars obtained by these production methods is insufficient in the cold workability as compared with conventional steel wire rods and bars subjected to softening annealing. At present, a soft steel wire rods and bars for machine structural use, which can be satisfactorily used in practice in the as-hot-rolled state, has not been attained.

The present inventors have studied these problems and have proposed a steel softened comparably with an annealed steel in Japanese Patent Application No. 11-146625. However, a steel capable of providing cold workability greater than conventional softened and annealed steels, even in the case of a large working degree, is still required.

DISCLOSURE OF THE INVENTION

Under these circumstances, the object of the present invention is to provide a steel wire rods and bars, for machine structural use, having, in the as-hot-rolled state, the same cold workability as a conventional hot-rolled wire rods and bars subjected to softening annealing.

The present inventors have taken notice of the structure and reduction of area (deformation ability) of the steel wire rods and bars obtained after the softening annealing and made studies to obtain the same structure and reduction of area (deformation ability) as those attainable by the softening annealing and thereby ensure cold workability in the as-hot-rolled state.

FIG. 1 is a microphotograph (at a magnification of 4,000) of a hot-rolled CH45K steel wire subjected to a normal softening treatment (700° C.×3 hr). As shown in FIG. 1, the microstructure of the steel is composed of ferrite 1 and lamellar pearlite, where some of the platy cementite in the lamellar pearlite is split to form a carbide 2. The softening of a steel is attributable to the partial ratio of a predetermined amount of ferrite in the steel structure and the split cementite in the lamellar pearlite, and this ensures the cold workability of steel wire.

The present inventors have found that when a steel wire rods and bars having a predetermined steel composition is roughly hot-rolled at a temperature of 850 to 1,000° C., finish-rolled at a temperature of 700 to 1,000° C., cooled to a temperature of 550 to 650° C. at a cooling rate of 0.1° C./sec or more, immediately kept at a furnace atmosphere temperature of 650 to 720° C. for 15 to 90 minutes and then allowed to cool, the obtained steel wire rods and bars can have a novel steel structure where, as shown in the microphotograph of FIG. 2(*a*) and the schematic view of microphotograph of FIG. 2(*b*), the ferrite partial ratio of ferrite 1 in the structure is high, the lamellar is split and some of the cementite in the lamellar pearlite 3 is spheroidized as seen from the spheroidized granular carbide 4 and the granular carbide 5 precipitated in the grain boundary and also found that this as-hot-rolled steel wire rods and bars has a high reduction of area and therefore, can surely have cold workability. The present invention has been accomplished based on these finding.

The gist of the present invention is in the followings.

(1) A hot-rolled steel wire rods and bars usable for machine structural use without annealing, comprising in terms of mass %, C: 0.1 to 0.5%, Si: 0.01 to 0.5%, Mn: 0.3 to 1.5% and the balance of Fe and unavoidable impurities, wherein the microstructure of steel is composed of ferrite and pearlite, the ferrite grain size is No. 11 or more as defined in JIS G 0552, a granular carbide having an equivalent-circle diameter of 2 $\mu$m or less and an aspect ratio of 3 or less is contained in an area ratio of 5 to 40%, and the steel has a tensile strength TS (MPa)$\leqq$573×Ceq+257 and a reduction of area RA (%)$\geqq$−23×Ceq+75 (wherein Ceq=C+Si/7+Mn/5+Cr/9+Mo/2).

(2) The hot-rolled steel wire rods and bars for machine structural use as described in (1) above, which further comprises one or more of, in terms of mass %, Cr: 0.2 to 2.0%, Mo: 0.1 to 1.0%, Ni: 0.3 to 1.5%, Cu: 1.0% or less, and B: 0.005% or less.

(3) The hot-rolled steel wire rods and bars for machine structural use as described in (1) or (2) above, which further comprises one or more of, in terms of mass %, Ti: 0.005 to 0.04%, Nb: 0.005 to 0.1%, and V: 0.03 to 0.3%.

(4) A method for producing a hot-rolled steel wire rods and bars usable for machine structural use without annealing, comprising roughly hot-rolling a steel having steel components described in any one of (1) to (3) above at a temperature of 850 to 1,000° C., finish-rolling the roughly hot-rolled steel at a temperature of 700 to 1,000° C., cooling the finish-rolled steel to a temperature of 550 to 650° C. at a cooling rate of 0.1° C./sec or more, holding the steel at a furnace atmosphere temperature of 650 to 720° C. for 15 to 90 minutes, and then allowing it to cool.

(5) A hot-rolled steel wire rods and bars for machine structural use, having a microstructure composed of ferrite and pearlite, containing a granular carbide having an equivalent-circle diameter of 2 $\mu$m or less and an aspect ratio of 3 or less in an area ratio of 5 to 40%, and having a tensile strength and a reduction of area specified by the following formulae (1) and (2), respectively, the ferrite having a grain size of No. 11 or more as defined in JIS G 0552:

$$TS \leqq 573 \times Ceq + 257 \quad (1)$$

$$RA \geqq -23 \times Ceq + 75 \quad (2)$$

wherein

Ceq=C+Si/7+Mn/5+Cr/9+Mo/2 (mass %)

TS: tensile strength (MPa)

RA: reduction of area (%).

(6) A method for producing a hot-rolled steel wire rods and bars usable for machine structural use without annealing, comprising roughly hot-rolling a steel having steel components described in any one of (1) to (3) above at a temperature of 700 to 1,200° C., finish-rolling the roughly hot-rolled steel at a temperature of 700 to 1,000° C., cooling the finish-rolled steel to a temperature of 200 to 650° C. at a cooling rate of 0.1° C./sec or more, holding the steel at a furnace atmosphere temperature of 600 to 850° C. for 15 to 240 minutes, and then allowing it to cool.

(7) A method for producing a hot-rolled steel wire rods and bars for machine structural use, comprising roughly hot-rolling a steel at a temperature of 700 to 1,200° C., finish-rolling the roughly hot-rolled steel at a temperature of 700 to 1,000° C., cooling the finish-rolled steel to a temperature of 200 to 650° C. at a cooling rate of 0.1° C./sec or more, holding the steel at a furnace atmosphere temperature of 600 to 850° C. for 15 to 240 minutes, and then allowing it to cool.

(8) A method for producing a hot-rolled steel wire rods and bars for machine structural use, comprising roughly hot-rolling a steel at a temperature of 850 to 1,000° C., finish-rolling the roughly hot-rolled steel at a temperature of 700 to 1,000° C., cooling the finish-rolled steel to a temperature of 550 to 650° C. at a cooling rate of 0.1° C./sec or more, holding the steel at a furnace atmosphere temperature of 650 to 720° C. for 15 to 90 minutes, and then allowing it to cool.

(9) A hot-rolled steel wire rods and bars for machine structural use, having a tensile strength and a reduction of area specified by the following formulae (1) and (2), respectively:

$$TS \leqq 573 \times Ceq + 257 \quad (1)$$

$$RA \geqq -23 \times Ceq + 75 \quad (2)$$

wherein

Ceq=C+Si/7+Mn/5+Cr/9+Mo/2 (mass %)

TS: tensile strength (MPa)

RA: reduction of area (%).

BRIEF DESCRIPTION OF THE DRAWINGS

FIG. 2(*b*) is a schematic view of the microphotogragh of FIG. 2(*a*) showing the structure of an as-hot-rolled steel wire of the present invention.

BEST MODE FOR CARRYING OUT THE INVENTION

The present invention is described in detail below.

A conventional hot-rolled steel wire rods and bars has a steel structure composed of ferrite and lamellar pearlite and has a high strength, therefore, the as-hot-rolled steel can hardly be cold-worked. For this reason, the steel is subjected to softening annealing before cold working and, after the cold working, is heat-treated for hardening and tempering to obtain a formed part having a predetermined strength.

In the present invention, a steel wire rods and bars having, in the as-hot-rolled state, a strength and a reduction of area equal to or greater than those of a steel subjected to softening annealing is obtained, whereby the as-hot-rolled steel can be cold-worked. In particular, the present invention proposes a hot-rolled steel wire rods and bars for machine structural use, having excellent deformation ability with a reduction of area RA (%)≧−23×Ceq+75 (wherein Ceq=C+Si/7+Mn/5+Cr/9+Mo/2).

Figure 1:
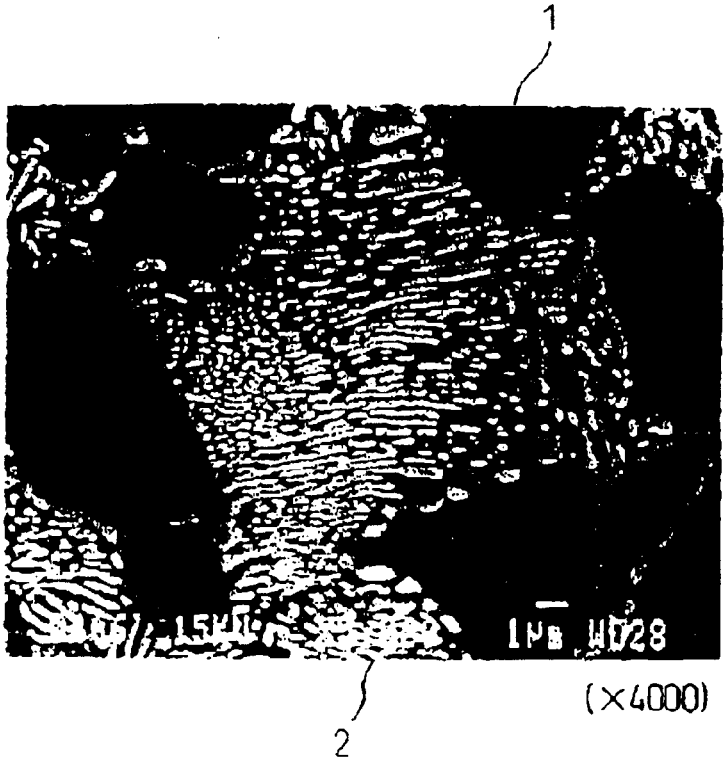
FIG. 1 is a microphotograph (×4,000) showing the structure of a steel obtained by subjecting a hot-rolled CH45K steel wire to normal annealing (700° C.×3 hr).
Figure 2A:
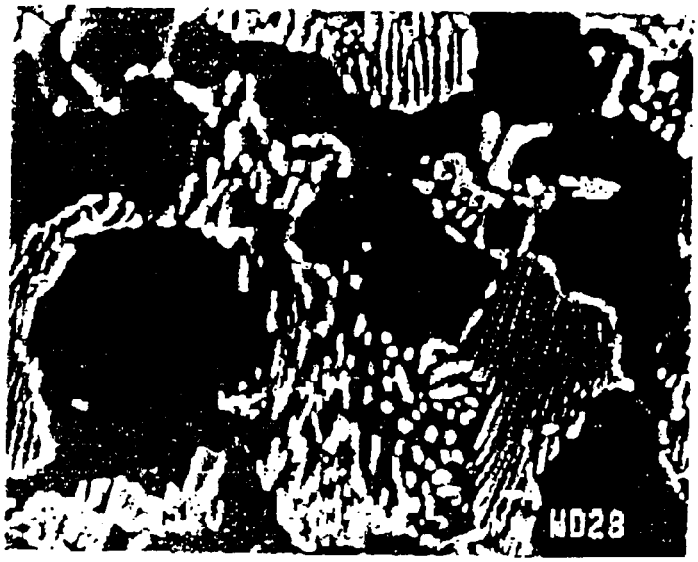
FIG. 2(*a*) is a microphotograph (×4,000) showing the structure of an as-hot-rolled steel wire of the present invention.
Figure 2B:
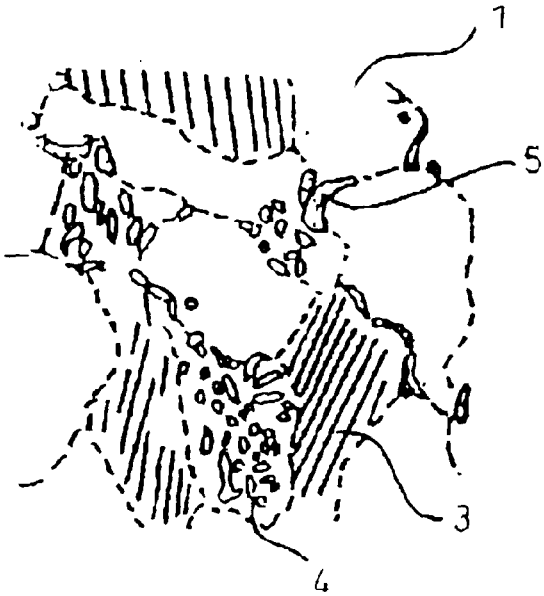
Figure 3:
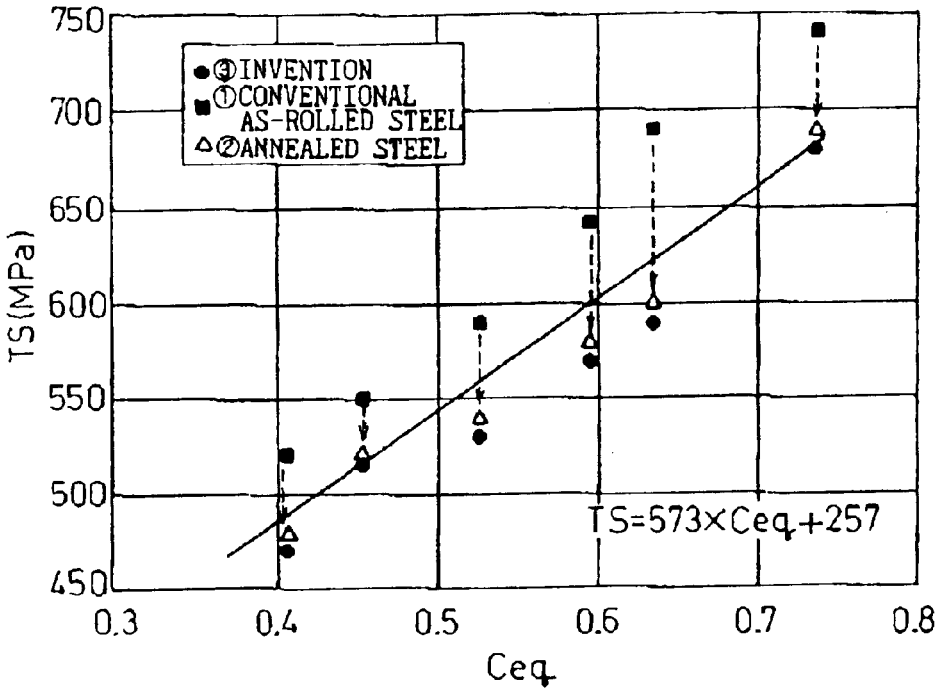
FIG. 3 is a view showing a comparison of the strengths of a conventional as-hot-rolled steel wire, a steel wire after normal annealing, and an as-hot-rolled steel wire of the present invention.

FIG. 3 is a view showing a comparison in the strengths of a conventional as-hot-rolled steel wire, a steel wire after normal annealing, and an as-hot-rolled steel wire of the present invention. In the Figure, (1) shows the strength of a conventional as-hot-rolled steel wire, (2) shows the strength of a steel wire subjected to normal annealing after hot rolling and (3) shows the strength of an as-hot-rolled steel wire of the present invention.

Figure 4:
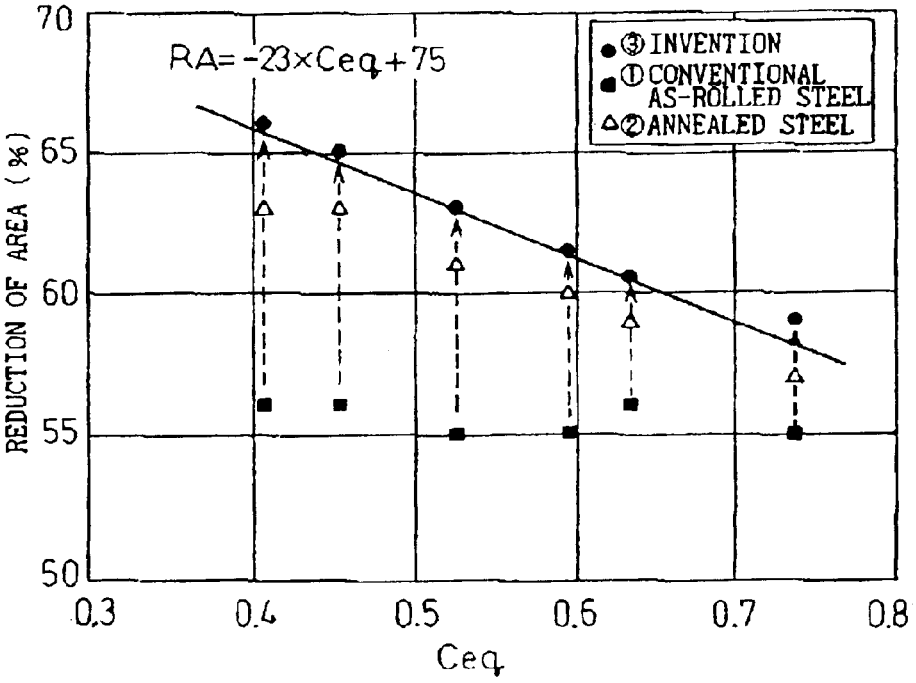
FIG. 4 is a view showing a comparison of the reduction of area of a conventional as-hot-rolled steel wire, a steel wire after normal annealing, and an as-hot-rolled steel wire of the present invention.

As shown in FIG. 3, in any of steel wires having different C amounts (0.25 to 0.45%), the as-hot-rolled steel wire (3) of the present invention is reduced in the strength by 60 to 100 MPa compared to the conventional as-hot-rolled steel wire (1) and this reveals that considerable softening is achieved. It was confirmed that the strength of (3) of the present invention is almost equal to the strength of a steel wire rods and bars obtained after normal annealing or the steel wire rods and bars of the present invention is rather softened. FIG. 4 is a view showing the comparison in the reduction of area among (1) a conventional as-hot-rolled steel wire, (2) a steel wire after normal annealing and (3) an as-hot-rolled steel wire of the present invention. It is seen that the as-hot-rolled steel wire (3) of the present invention is more softened and more improved in the reduction of area than the steel wire (2) subjected to normal annealing after hot rolling. According to conventional techniques, the steel may be broken during cold forging under severe conditions of working. However, the as-hot rolled steel wire (3) of the present invention is confirmed not to undergo breakage even at a compressibility of 80% or more (at a compressibility exceeding 80%, the die of the measuring apparatus may be damaged and the test cannot be performed).

The granular carbide necessary for achieving the softening is a granular carbide having an equivalent-circle diameter of 2 $\mu$m or less and an aspect ratio of 3 or less. This granular carbide is clearly distinguished from the carbide generated due to split of a platy carbide on annealing. In order to have high deformation ability to prevent breakage even at a reduction of 80%, the reduction of area must be RA (%)$\geqq -23\times Ceq+75$ (wherein Ceq=C+Si/7+Mn/5+Cr/9+Mo/2).

In order to achieve softening equal to that of an annealed steel wire, the ferrite grains present in the microstructure must be made fine and to have a grain size of No. 11 or more as defined in JIS G 0552. If the ferrite grain size is less than No. 11, the granulation of cementite present in the pearlite insufficiently proceeds and desired softening cannot be achieved. Furthermore, to achieve the softening, the amount of a granular carbide must be present from 5 to 15% in terms of area ratio and is preferably 10% or more.

The as-hot-rolled blank is used for obtaining a formed part by cold forging using a metal mold and therefore, when the blank is decreased in the strength (softened) by 100 MPa, the life of metal mold is prolonged by 4 to 5 times. Accordingly, in order to greatly improve the life of metal mold, the as-hot-rolled steel wire rods and bars of the present invention satisfies the relationship of tensile strength; TS (MPa)$\leqq 573\times Ceq+257$ (wherein Ceq=C+Si/7+Mn/5+Cr/9+Mo/2). If this relationship is not satisfied, the deformation ability cannot be ensured and the softening annealing is difficult to eliminate.

The reasons why the components of the objective steel are limited in the present invention are described below.

C is an element necessary for increasing the strength of parts for machine structural use. If the C content is less than 0.1%, the final product is deficient in the strength, whereas if it exceeds 0.5%, the final product is rather deteriorated in the toughness. Therefore, the C content is specified to 0.1 to 0.5%.

Si is added as a deoxidizing element for increasing the strength of final product by the hardening of a solid solution. If the Si content is less than 0.01%, insufficient hardening results, whereas if it exceeds 0.5%, the hardening is saturated and the toughness is rather deteriorated. Therefore, the Si content is specified to 0.01 to 0.5%. For the deoxidization of steel, deoxidization by Al is employed in addition to the deoxidization by Si. Particularly, for lowering the oxygen content, strong Al deoxidization is preferred. In this case, 0.2% or less of Al sometimes remains in the steel, however, such residual Al is allowable in the present invention.

Mn is an element effective for increasing the strength of a final product through the improvement of hardening property. If the Mn content is less than 0.3%, the effect is insufficient, whereas if it exceeds 1.5%, the effect is saturated and the toughness is rather deteriorated. Therefore, the Mn content is specified to 0.3 to 1.5%.

S is a component unavoidably contained in the steel. In the steel, S is present as MnS and contributes to the improvement of machinability and formation of a fine structure and therefore, 0.1% or less of S is allowable in the present invention. However, S is a harmful element for cold formation and if machinability is not required, the S content is preferably reduced to 0.035% or less.

P is also a component unavoidably contained in the steel, however, P brings about intergranular segregation giving rise to the deterioration of toughness and therefore, is preferably reduced to 0.035% or less.

These are fundamental components of the objective steel of the present invention, however, in the present invention, the steel may further contain one or more of Cr, Mo, Ni, Cu and B. These elements are added so as to increase the strength of a final product by enhancing the hardening property or the like. However, addition of these elements in a large amount disadvantageously incurs the formation of a bainite or martensite structure in the as-hot-rolled steel to increase the hardness and, in view of profitability, this is not preferred. Therefore, their contents are specified to Cr: 0.2 to 2.0%, Mo: 0.1 to 1.0%, Ni: 0.3 to 1.5%, Cu: 1.0% or less and B: 0.005% or less.

Furthermore, in the present invention, one or more of Ti, Nb and V can be contained for the purpose of adjusting the grain size. However, if the Ti content is less than 0.005%, the Nb content is less than 0.005% and the V content is less than 0.03%, a remarkable effect cannot be obtained, whereas if the Ti content exceeds 0.04%, the Nb content exceeds 0.1% and the V content exceeds 0.3%, the effect is saturated and the toughness is rather deteriorated. Therefore, their contents are specified to Ti: 0.005 to 0.04%, Nb: 0.005 to 0.1% and V: 0.03 to 0.3%.

The method for producing a steel wire and rod for machine structural use of the present invention is described below.

In the present invention, a steel described in any one of claims 1 to 3 is hot-rolled to refine the austenite grains, then cooled to complete the ferrite-pearlite transformation and subsequently reheated to obtain a steel wire rods and bars having a novel steel structure. Thus obtained steel wire rods and bars is, in the as-hot-rolled state, softened and has a high reduction of area, therefore, this can serve as a steel wire rods and bars for machine structural use having good cold workability.

In the present invention, a steel wire rods and bars is roughly hot-rolled at a temperature of 850 to 1,000° C. finish-rolled at a temperature of 700 to 1,000° C., cooled to a temperature of 550 to 650° C. at a cooling rate of 0.1°/sec or more to complete the ferrite-pearlite transformation, held at a furnace atmosphere temperature of 650 to 720° C. for 15 to 90 minutes, and then allowed to cool.

The rough hot-rolling temperature is specified to 850 to less than 1,000° C., because if the temperature is less than 850° C., the rolling becomes difficult in view of load of a rolling mill, whereas if it is 1,000° C. or more, the austenite crystal grains become coarse and a steel having a ferrite grain size of No. 11 or more after the rolling cannot be obtained. If the finish-rolling temperature exceeds 1,000° C., a steel having a ferrite grain size of No. 11 or more cannot be obtained. Therefore, in the present invention, the allowable upper limit temperature is specified to 1,000° C. On the other hand, if the finish-rolling temperature is less than 700° C., rolling takes place in an austenite-ferrite dual phase zone and after the hot-rolling, a uniformly fine ferrite-pearlite structure cannot be obtained. In addition, it is not preferable that a partial acicular ferrite-bainite structure is formed. Therefore, the finish-rolling is performed in a temperature range from 700 to 1,000° C.

The steel is cooled at a cooling rate of 0.1° C./sec or more to complete the ferrite-pearlite transformation. This is specified because, if the cooling rate deviates from the range of 0.1° C./sec or more, transformation takes time and industrial production is impossible. The cooling rate is preferably from 0.1 to 50° C./sec. Also, after the finish-rolling, the temperature is set to 550 to 650° C. to complete the ferrite-pearlite transformation. If the steel temperature at the finish of pearlite transformation is less than 550° C., the steel inside a coil, which temperature is difficult to elevate by the subsequent heating, takes a long time (90 minutes or more) to reach a temperature range of 650° C. or more and this incurs serious reduction of productivity and an increase in cost. Furthermore, if the steel is cooled to less than 550° C., a hard bainite structure is produced in some steels. Therefore, the lower limit of temperature is specified to 550° C. On the other hand, if the steel temperature exceeds 650° C. at the finish of pearlite transformation, a long time is necessary until the completion of pearlite transformation and this causes reduction of productivity, a useless increase in the length of a cooling line and elevation of equipment cost and is not profitable. Therefore, the upper limit of temperature is specified to 650° C.

After the completion of ferrite-pearlite transformation, the heating temperature and heating time are specified as from 650 to 720° C. and from 15 to 90 minutes, respectively. This is because if the temperature is less than 650° C., granulation of cementite and increase of ferrite partial ratio cannot be achieved and, as a result, softening and high reduction of area cannot be obtained. On the other hand, if the temperature exceeds 720° C., a part of the ferrite-pearlite structure is again austenitized and the strength is elevated by the subsequent step of allowing the steel to cool. Therefore, the heating temperature is specified as from 650 to 720° C. Furthermore, if the heating time is less than 15 minutes, the temperature is not sufficiently elevated inside the coil and desired softening and reduction of area cannot be attained. Therefore, the heating time is specified as 15 minutes or more. On the other hand, if the heating time exceeds 90 minutes, this disadvantageously incurs a serious reduction in productivity in view of equipment and, in turn, an increase in cost. Therefore, the heating time is specified as 90 minutes or less.

As a result, a steel wire or rod where the microstructure of steel is composed of ferrite and pearlite, the ferrite crystal grain size is No. 11 or more as defined in JIS G 0552, a granular carbide having an equivalent-circle diameter of 2 $\mu$m or less and an aspect ratio of 3 or less is contained in an area ratio of 5 to 40% and the steel has a tensile strength TS (MPa)$\leqq 573\times Ceq+257$ and a reduction of area RA (%)$\geqq -23\times Ceq+75$ (wherein $Ceq=C+Si/7+Mn/5+Cr/9+Mo/2$), can be obtained.

EXAMPLES

The present invention is described in greater detail below by referring to Examples.

Chemical components of each sample steel are shown in Table 1. All of the sample steels were produced by continuous casting process after a converter process. Each sample steel was hot-rolled into a billet of 162 mm square and then hot-rolled into a steel wire having a diameter of 11 mm under the rolling conditions shown in Table 2. In the rolling level (1) according to the method of the present invention, the steel wire rods and bars was roughly hot-rolled at 950° C., finish-rolled at 900° C., falling in the temperature range from 700 to 1,000° C., taken up into a ring form, immediately dipped in a boiling water tank, thereby cooled to 600° C., which falls in the temperature range from 550 to 650° C., and then immediately formed into a coil form. The coil was heated at 700° C. for 30 minutes while moving it in a furnace and then allowed to cool outside the furnace. In the comparative level (2), steel wires shown by the numbers (2, 11 and 20) in Table 3 were obtained in the same manner as in the rolling level (1) according to the method of the present invention except that the steel billet was roughly hot-rolled at 1,050° C. which is higher than the temperature range from 850 to 1,000° C.

In the comparative level (3), steel wires shown by the numbers (3, 12 and 21) in Table 3 were obtained in the same manner as in the rolling level (1) according to the method of the present invention except that the steel wires were finish-rolled at 1,050° C. which is higher than the temperature range from 700 to 1,000° C. In the comparative level (4), steel wires shown by the numbers (4, 13 and 22) in Table 3 were obtained in the same manner as in the rolling level (1) according to the method of the present invention except that the steel wire rods and bars was cooled to a cooling final temperature of 660° C. which is higher than the temperature range from 550 to 650° C. In the comparative levels (5) and (6), steel wires shown by the numbers (5, 6, 14, 15, 23 and 24) in Table 3 were obtained in the same manner as in the rolling level (1) according to the method of the present invention except that the coil was heated at a furnace atmosphere temperature of 600° C. which is lower than the temperature range from 650 to 720° C. (comparative level (5)) or at a furnace atmosphere temperature of 730° C. which is higher than the temperature range from 650 to 720° C. (comparative level (6)).

In the comparative level (7), steel wires shown by the numbers (7, 16 and 25) in Table 3 were obtained in the same manner as in the rolling level (1) according to the method of the present invention except that the coil was held for 10 minutes which is shorter than the range from 15 to 90 minutes. In the comparative level (8), the steel strip was roughly hot-rolled at 900° C. and finish-rolled at 750° C., the subsequent cooling was adjusted by spreading a slow cooling cover on a transportation line and placing the taken-up coil in a slow cooling furnace, and then the coil was allowed to cool, thereby obtaining steel wires shown by the numbers (8, 17 and 26) in Table 3. In the comparative level (9), the steel billet was roughly hot-rolled at 1,000° C. and finish-rolled at 900° C., the subsequent cooling was adjusted by spreading a slow cooling cover on the coil transportation line, and then the coil was allowed to cool. The coil after the cooling was further subjected to softening annealing under the conditions that the coil was kept at 700° C. for 4 hours and then allowed to cool, whereby steel wires shown by the numbers (9, 18 and 27) in Table 3 were obtained.

From each finished steel wire, a JIS No. 2 tensile test specimen and a cold compression test specimen of 10 $\phi$mm (diameter)×15 mm (length) were prepared and by performing a tensile test and a both ends-restraining cold compression test, the tensile strength, the reduction of area and the critical compressibility were determined. Furthermore, as the characteristic features in view of structure, the microstructure, the ferrite partial ratio, the number of ferrite grain size and the area ratio of granular carbide are shown in Table 3 for the comparison between the present invention and comparative example. As apparent from these, Nos. 1, 10 and 19 of the present invention have a higher reduction of area and a higher critical compressibility than those in Nos. 8, 17 and 26 of Comparative Example. Also, it was confirmed that the softening, the reduction of area and the critical compression of the steel of the present invention each reaches a level equal to or higher than those of the steel subjected to rolling and softening annealing of Nos. 9, 18 and 27 of Comparative Example.

TABLE 1 unit: mass %

| Steel No. | C | Si | Mn | P | S | Cr | Mo | Al | Ni | Cu | B | Ti | Nb | V | Ceq |
|---|---|---|---|---|---|---|---|---|---|---|---|---|---|---|---|
| A | 0.44 | 0.23 | 0.78 | 0.014 | 0.025 | 0.05 | 0.00 | 0.023 | — | — | — | — | — | — | 0.634 |
| B | 0.35 | 0.19 | 0.80 | 0.015 | 0.022 | 1.00 | 0.18 | 0.033 | — | — | — | — | — | — | 0.738 |
| C | 0.24 | 0.19 | 0.96 | 0.020 | 0.018 | 0.17 | 0.00 | 0.030 | — | — | 0.0020 | 0.02 | 0.05 | — | 0.478 |

TABLE 2

| Rolling Level | Diameter of Hot-Rolled Steel Wire Rods (mm) | Rough Rolling Temperature (° C.) | Finishing Temperature (° C.) | Final Cooling Temperature (° C.) | Cooling Rate (° C./S) | Furnace Atmosphere Temperature (° C.) | Heat-Treating Time (min.) | Remarks |
|---|---|---|---|---|---|---|---|---|
| (1) | 11 | 950 | 900 | 600 | 10 | 700 | 30 | Invention |
| (2) | 11 | 1050 | 900 | 600 | 5 | 700 | 30 | Comparison |
| (3) | 11 | 1000 | 1050 | 600 | 10 | 700 | 30 | " |
| (4) | 11 | 950 | 900 | 660 | 20 | 700 | 30 | " |
| (5) | 11 | 950 | 900 | 600 | 10 | 640 | 90 | " |
| (6) | 11 | 950 | 900 | 600 | 5 | 730 | 15 | " |
| (7) | 11 | 950 | 900 | 650 | 0.1 | 700 | 10 | " |

| Rolling Level | Diameter of Hot-Rolled Steel Wire Rods (mm) | Rough Rolling Temperature (° C.) | Finishing Temperature (° C.) | Average Cooling Rate to 700 to 650° C. (° C./S) | Remarks |
|---|---|---|---|---|---|
| (8) | 11 | 900 | 750 | 0.1 | — |
| (9) | 11 | 1000 | 900 | 0.5 | softening annealing of 700° C. × 4 hours after cooling |

TABLE 3

| | | | | As-Rolled Steel | | | | | | | Softened Annealed Steel | | |
|---|---|---|---|---|---|---|---|---|---|---|---|---|---|
| No. | Division | Level | Steel No. | Tensile Strength (MPa) | Reduction of Area (%) | Critical Compress-ibility (%) | Microstructure | F Par-tial Ratio (%) | No. of F Grain Size | Area Ratio of Gran-ulated Carbide (%) | Tensile Strength (MPa) | Reduction of Area (%) | Critical Compress-ibility (%) |
| 1 | Invention | (1) | A | 575 | 60.0 | 80% or more | F + P + granular C | 70 | 11.5 | 12 | — | — | — |
| 2 | Comparison | (2) | | 603 | 58.3 | — | F + P + granular C | 58 | 9.5 | 7 | — | — | — |
| 3 | " | (3) | | 604 | 56.0 | — | F + P + granular C | 53 | 9.5 | 5 | — | — | — |
| 4 | " | (4) | | 605 | 58.0 | — | F + P + granular C | 55 | 11.0 | 4 | — | — | — |
| 5 | " | (5) | | 612 | 56.3 | — | F + P + granular C | 49 | 11.1 | 6 | — | — | — |
| 6 | " | (6) | | 617 | 54.2 | — | F + P + granular C | 55 | 11.2 | 8 | — | — | — |
| 7 | " | (7) | | 602 | 56.3 | — | F + P + granular C | 52 | 11.0 | 7 | — | — | — |
| 8 | " | (8) | | 591 | 54.0 | 65% | F + P + granular C | 68 | 11.5 | 10 | — | — | — |
| 9 | " | (9) | | 704 | 52.0 | — | F + P | 48 | 8.7 | 0 | 589 | 59.0 | 75% |
| 10 | Invention | (1) | B | 615 | 59.0 | 80% or more | F + P + granular C | 60 | 11.8 | 8 | — | — | — |
| 11 | Comparison | (2) | | 630 | 53.1 | — | F + P + granular C | 52 | 9.5 | 6 | — | — | — |
| 12 | " | (3) | | 633 | 52.8 | — | F + P + granular C | 53 | 10 | 8 | — | — | — |
| 13 | " | (4) | | 638 | 51.4 | — | F + P + granular C | 57 | 11.0 | 9 | — | — | — |
| 14 | " | (5) | | 638 | 54.2 | — | F + P + granular C | 54 | 11.1 | 5 | — | — | — |
| 15 | " | (6) | | 640 | 51.8 | — | F + P + granular C | 55 | 11.3 | 7 | — | — | — |
| 16 | " | (7) | | 651 | 52.4 | — | F + P + granular C | 53 | 11.4 | 6 | — | — | — |
| 17 | " | (8) | | 632 | 55.0 | 65% | F + P + granular C | 55 | 11.7 | 5 | — | — | — |
| 18 | " | (9) | | 734 | 49.0 | — | F + P | 45 | 8.6 | 0 | 619 | 57.0 | 75% |
| 19 | Invention | (1) | C | 430 | 85.0 | 88% or more | F + P + granular C | 85 | 12.1 | 30 | — | — | — |
| 20 | Comparison | (2) | | 440 | 63.0 | — | F + P + granular C | 84 | 8.9 | 8 | — | — | — |
| 21 | " | (3) | | 460 | 62.3 | — | F + P + granular C | 83 | 9.0 | 6 | — | — | — |
| 22 | " | (4) | | 461 | 61.5 | — | F + P + granular C | 84 | 11.2 | 7 | — | — | — |
| 23 | " | (5) | | 455 | 59.2 | — | F + P + granular C | 80 | 11.4 | 8 | — | — | — |
| 24 | " | (6) | | 457 | 60.2 | | F + P + granular C | 79 | 12.0 | 5 | — | — | — |

TABLE 3-continued

| | | | | As-Rolled Steel | | | | | | | | Softened Annealed Steel | | |
|---|---|---|---|---|---|---|---|---|---|---|---|---|---|---|
| No. | Division | Level | Steel No. | Tensile Strength (MPa) | Reduction of Area (%) | Critical Compressibility (%) | Microstructure | F Partial Ratio (%) | No. of F Grain Size | Area Ratio of Granulated Carbide (%) | Tensile Strength (MPa) | Reduction of Area (%) | Critical Compressibility (%) |
| 25 | " | (7) | | 462 | 58.9 | — | F + P + granular C | 62 | 11.0 | 7 | — | — | — |
| 26 | " | (8) | | 544 | 56.3 | 65% | F + P + granular C | 85 | 12.1 | 7 | — | — | — |
| 27 | " | (9) | | 562 | 55.0 | — | F + P | 64 | 8.8 | 0 | 529 | 63.0 | 75% |

F: ferrite, P: pearlite, Zw: bainite, granular C: granular carbide

INDUSTRIAL APPLICABILITY

The hot-rolled steel wire rods and bars for machine structural use of the present invention is, in the as-hot-rolled state, softened and has a high reduction of area without passing through softening annealing and the softness, reduction of area and critical compressibility thereof are equal to or higher than those of a conventional steel wire rods and bars subjected to softening annealing. Accordingly, it is not necessary to apply softening annealing before cold working as in conventional cases, so that improvements in productivity and in energy saving can be achieved and an effect of greatly elongating the life of metal mold used for cold working can be provided.

What is claimed is:

1. A hot-rolled steel wire rods and bars usable for machine structural use without annealing, comprising in terms of mass %, C: 0.1 to 0.5%, Si: 0.01 to 0.5%, Mn: 0.3 to 1.5% and the balance of Fe and unavoidable impurities, wherein the microstructure of steel is composed of ferrite and pearlite, the ferrite grain size is No. 11 or more as defined in JIS G 0552, a granular carbide having an equivalent-circle diameter of 2 μm or less and an aspect ratio of 3 or less is contained in an area ratio of 5 to 40%, and the steel has a tensile strength and a reduction of area specified by the following formulae (1) and (2), respectively:

$$TS \leqq 573 \times Ceq + 257 \quad (1)$$

$$RA \geqq -23 \times Ceq + 75 \quad (2)$$

wherein

Ceq=C+Si/7+Mn/5+Cr/9+Mo/2 (mass %)

TS: tensile strength (MPa)

RA: reduction of area (%).

2. The hot-rolled steel wire rods and bars for machine structural use as claimed in claim 1, which further comprises one or more of, in terms of mass %, Cr: 0.2 to 2.0%, Mo: 0.1 to 1.0%, Ni: 0.3 to 1.5%, Cu: 1.0% or less, and B: 0.005% or less.

3. The hot-rolled steel wire rods and bars for machine structural use as claimed in claim 1 or 2, which further comprises one or more of, in terms of mass %, Ti: 0.005 to 0.04%, Nb: 0.005 to 0.1%, and V: 0.03 to 0.3%.

4. A hot-rolled steel wire rods and bars for machine structural use, having a microstructure composed of ferrite arid pearlite, containing a granular carbide having an equivalent-circle diameter of 2 μm or less and an aspect ratio of 3 or less in an area ratio of 5 to 40%, and having a tensile strength and a reduction of area specified by the following formulae (1) and (2), respectively, the ferrite having a grain size of No. 11 or more as defined in JIS G 0552:

$$TS \leqq 573 \times Ceq + 257 \quad (1)$$

$$RA \geqq -23 \times Ceq + 75 \quad (2)$$

wherein

Ceq=C+Si/7+Mn/5+Cr/9+Mo/2 (mass %)

TS: tensile strength (MPa)

RA: reduction of area (%).

5. A method for producing a hot-rolled steel wire rods and bars for machine structural use, comprising roughly hot-rolling a steel at a temperature of 700 to 1,200° C., finish-rolling the roughly hot-rolled steel at a temperature of 700 to 1,000° C., cooling the finish-rolled steel to a temperature of 200 to 650° C. at a cooling rate of 0.1° C./sec or more, holding the steel at a furnace atmosphere temperature of 600 to 850° C. for 15 to 240 minutes, and then allowing it to cool.

6. A method for producing a hot-rolled steel wire rods and bars for machine structural use, comprising roughly hot-rolling a steel at a temperature of 850 to 1,000° C., finish-rolling the roughly hot-rolled steel at a temperature of 700 to 1,000° C., cooling the finish-rolled steel to a temperature of 550 to 650° C. at a cooling rate of 0.1° C./sec or more, holding the steel at a furnace atmosphere temperature of 650 to 720° C. for 15 to 90 minutes, and then allowing it to cool.

7. A hot-rolled steel wire rods and bars for machine structural use, having a tensile strength and a reduction of area specified by the following formulae (1) and (2), respectively:

$$TS \leqq 573 \times Ceq + 257 \quad (1)$$

$$RA \geqq -23 \times Ceq + 75 \quad (2)$$

wherein

Ceq=C+Si/7+Mn/5+Cr/9+Mo/2 (mass %)

TS: tensile strength (MPa)

RA: reduction of area (%).

8. A method for producing a hot-rolled steel wire rods and bars usable for machine structural use without annealing, comprising roughly hot-rolling a steel having steel components claimed in claim 1 or 2 at a temperature of 850 to 1,000° C., finish-rolling the roughly hot-rolled steel at a temperature of 700 to 1,000° C., cooling the finish-rolled steel to a temperature of 550 to 650° C. at a cooling rate of 0.1° C./sec or more, holding the steel at a furnace atmosphere temperature of 650 to 720° C. for 15 to 90 minutes, and then allowing it to cool.

9. A method for producing a hot-rolled steel wire rods and bars usable for machine structural use without annealing, comprising roughly hot-rolling a steel having steel components claimed in claim 1 or 2 at a temperature of 700 to 1,200° C., finish-rolling the roughly hot-rolled steel at a temperature of 700 to 1,000° C., cooling the finish-rolled steel to a temperature of 200 to 650° C. at a cooling rate of 0.1° C./sec or more, holding the steel at a furnace atmosphere temperature of 600 to 850° C. for 15 to 240 minutes, and then allowing it to cool.

* * * * *